United States Patent [19]

Hattori et al.

[11] Patent Number: 4,979,995

[45] Date of Patent: Dec. 25, 1990

[54] MEMBER MADE OF NICKEL BASE ALLOY HAVING HIGH RESISTANCE TO STRESS CORROSION CRACKING AND METHOD OF PRODUCING SAME

[75] Inventors: Shigeo Hattori, Ibaraki; Rikizo Watanabe, Yasugi; Yasuhiko Mori, Mito; Isao Masaoka, Hitachi; Ryoichi Sasaki, Hitachi; Hisao Itow, Hitachi, all of Japan

[73] Assignees: Hitachi, Ltd.; Hitachi Metals, Ltd., both of Tokyo, Japan

[21] Appl. No.: 331,184

[22] Filed: Mar. 31, 1989

Related U.S. Application Data

[63] Continuation of Ser. No. 333,414, Dec. 22, 1981, abandoned.

[30] Foreign Application Priority Data

Dec. 24, 1980 [JP] Japan ..... 55-182132

[51] Int. Cl.[5] ..... C22F 1/10

[52] U.S. Cl. ..... 148/2; 148/11.5 N; 148/12.7 N; 148/410; 148/428; 376/277

[58] Field of Search ..... 148/2, 12.7 N, 11.5 N, 148/410, 428; 376/277

[56] References Cited

FOREIGN PATENT DOCUMENTS 55-2786 1/1980 Japan .

*Primary Examiner*—R. Dean

*Attorney, Agent, or Firm*—Antonelli, Terry, Stout & Kraus

[57] ABSTRACT

A member adapted for use under a stress in an atmosphere of a temperature below the creep temperature and made from an Ni base alloy having a high resistance to stress corrosion cracking. The Ni alloy consists essentially of, by weight, 15 to 25% of Cr, 1 to 8% of Mo, 0.4 to 2% of Al, 0.7 to 3% of Ti, 0.7 to 4.5% of Nb and the balance Ni, and has an austenite matrix in which precipitated is at least one of $\gamma'$ phase and $\gamma''$ phase. The member can suitably used as parts which are subjected to pure water in nuclear reactor.

20 Claims, 3 Drawing Sheets

MEMBER MADE OF NICKEL BASE ALLOY HAVING HIGH RESISTANCE TO STRESS CORROSION CRACKING AND METHOD OF PRODUCING SAME

This is a continuation of application Ser. No. 333,414, filed Dec. 22, 1989, now abandoned.

BACKGROUND OF THE INVENTION

1. Field of the Invention

The present invention relates to a member made of an Ni base alloy having a high resistance to stress corrosion cracking, suitable for use under an atmosphere of a temperature below creep temperature, particularly in contact with water of high temperature in various plants treating high temperature water such as boiling water reactors or pressurized water reactors. More particularly, the invention relates to various parts made of the Ni base alloy such as retainer beam of jet pump for nuclear reactors, springs and bolts used in the nuclear reactors and so forth. The invention is concerned also with a method of producing such parts.

2. Description of the Prior Art

An alloy generally called inconel X750 (referred to as X750 alloy, hereinafter), i.e. Aerospace Material Specification (AMS) 5667H, which is an Ni base alloy of the precipitation strengthening type having a high modulus of elasticity and a large high-temperature strength, finds a spreading use as the material of various parts in nuclear reactors, such as retainer beam of jet pump, springs, bolts and so forth. This X750 alloy has a Cr content of around 15% and is usually regarded as being a corrosion resistant material. According to the result of studies made by the present inventors, however, it has been proved that the X750 alloy often occurs stress corrosion cracking when used in contact with water of a high temperature such as the water circulated through nuclear reactors, depending on the nature or quality of the water. More specifically, the X750 alloy tends to exhibit an intergranular stress corrosion cracking when it is subjected to a pure water of a high temperature of about 290° C. under a condition subjected to tensile stress, particularly when there is a crevice in the surface onto which the tensile stress acts.

The specifications of USSN 1967-653665 and USSN 1965-459110 disclose Ni-base alloys having a high resistance to stress corrosion cracking suitable for use in contact with highly pure water of high pressure and temperature, as in the case of pressure vessel type heat exchangers, steam generator and so forth. More specifically, the specification of USSN 1967-653665 discloses an alloy consisting essentially of 14 to 35% of Cr, 0 to 25% of Fe, less than 0.5% of one or both of Ti and Al, 0 to 15% of C, 0 to 1% of Si, 0 to 7.7% of Mo, 0 to 1.2% of Ta and the balance Ni, wherein the Cr content is less than 20% when the alloy has a substantial Mo or Ta content. On the other hand, the specification of USSN 1965-459110 discloses an improvement in the Ni base alloy mentioned above, consisting essentially of 26 to 32% of Cr, less than 0.1% of C, less than 5% of Ti, less than 5% of Al, less than 2% of Mn, less than 2.5% of Si, 52 to 67% of Ni and the balance Fe, and an alloy containing, in addition to the constituents mentioned above, at least one of less than 10% of Mo, less than 6% of Nb, less than 10% of V and less than 10% of W.

The alloys disclosed in these literatures, however, proved to have insufficient strength against the crevice corrosion cracking in the aforementioned parts forming a crevice therebetween.

SUMMARY OF THE INVENTION

Objects of the Invention

Accordingly, an object of the invention is to provide a member made of an Ni base alloy having a superior stress corrosion cracking resistance when used in contact with a high-temperature water under the presence of crevice and stress, at a temperature below the creep temperature, the typical examples of such members being a beam of a jet pump, springs and bolts used in nuclear reactors.

Another object of the invention is to provide a method of producing such members from the Ni base alloy mentioned above.

STATEMENT OF INVENTION

To this end, according to the invention, there is provided a member adapted to be used in an atmosphere below the creep temperature and under the presence of a stress, the member being made of an Ni base alloy consisting essentially of, by weight, 15 to 25% of Cr, 1 to 8% of Mo, 0.4 to 2% of Al, 0.7 to 3% of Ti, 0.7 to 4.5% of Nb and the balance Ni, and having a matrix of austenite structure containing at least one of $\gamma'$ and $\gamma''$ phase(s). The $\gamma'$ phase solely is obtained when the Nb content is small while the Al and Ti contents are large, whereas the $\gamma''$ phase solely is obtained in the contrary case, i.e. when the Nb content is large while the Al and Ti contents are small. The structure containing both of $\gamma'$ and $\gamma''$ phases is obtained, therefore, when the alloy has suitable Nb content and Al and Ta contents. The $\gamma'$ phase is an intermetallic compound of $Ni_3(Al, Ti)$, while the $\gamma''$ phase is an intermetallic compound of $Ni_3Nb$.

The Ni base alloy in accordance with the invention has a high resistance to the stress corrosion cracking in water of high temperature and under the presence of a crevice (hereinafter, referred to as "resistance to crevice corrosion cracking") mainly due to the co-existance of Cr and Mo and, in addition, makes it possible to suppress various factors adversely affecting the stress corrosion cracking resistance thereby aiming at precipition pardening, by means of suitably adjusting the Al, Ti and Nb contents.

The present inventors have made various studies concerning the precipitation-strengthened Ni base alloy to examine various properties such as easiness of the melting and casting in the production process, metallic structures after being subjected to various heat treatments, resistance to crevice corrosion cracking in high temperature water, mechanical properties and so forth.

The following facts were confirmed as the results of the studies.

(1) The co-existance of more than 15% of Cr and more than several percents of Mo provides a remarkable increase in the resistance to hot-water crevice corrosion cracking. However, as the Cr and Mo contents are increased unlimitedly, the austenite matrix becomes unstable thereby tending to permit the precipitation of phases which impair the mechanical properties and corrosion resistance.

(2) The addition of Nb is essential for obtaining a high hardenability because the Nb provides a greater effect on the precipitation strengthening as compared with Al and Ti. However, the Nb alone cannot provide the sufficiently large mechanical strength.

(3) An Nb content in excess of 5% permits the formation of coarse carbides and intermetallic compounds in the course of the production and heat treatments, thereby deteriorating the resistance to crevice corrosion cracking, as well as mechanical properties.

With these knowledges, the present inventors have accomplished the present invention through limiting the content of each constituent as stated before, for the following reasons.

At least 15% of Cr is essential for obtaining a sufficiently high resistance to stress corrosion cracking by the co-existence with Mo. On the other hand, a Cr content exceeding 25% undesirably deteriorates the hot workability. In addition, such high Cr content causes also the formation of detrimental phases such as $\sigma$ phase, $\mu$ phase and Laves phase, which are known as TCP (tetragonal cross pack) structure, thereby deteriorating the mechanical properties and resistance to crevice corrosion cracking. For these reasons, the Cr content should be selected to be between 15 and 25% and, more preferably, between 17 and 23%.

The Mo is effective in reinforcing the corrosion resistance derived from the Cr thereby improving the resistance to crevice corrosion cracking. The effect of Mo becomes appreciable when its content exceeds 1%. An Mo content exceeding 8%, however, permits the formation of detrimental phases to deteriorate the mechanical strength and lowers the corrosion resistance to degrade the resistance to crevice corrosion cracking, as in the case of the Cr content. Such high Mo content causes also a deterioration in hot workability of the alloy. Thus, the Mo content is preferably selected to be between 1.5 and 5%.

The Fe content greater than the amount inevitably involved in ordinary melting process stabilizes the matrix structure to improve the corrosion resistance. If the Fe content is increased unlimitedly, however, detrimental phases such as Laves phase are formed undesirably. The Fe content, therefore, should not exceed 40%. Preferably, the Fe content is selected to be between 5 and 30%.

The Al, Ti and Nb form intermetallic compounds with Ni to contribute to the precipitation strengthening. Further, the Al and Ti contribute to the deoxidation and strengthening of the alloy. The contribution of these elements to the precipitation strengthening, however, is somewhat small as compared with that of Nb. The precipitation strengthening is effected mainly by the precipitation of gamma prime phase ($\gamma'$ phase) of $Ni_3X$ type. It is possible to obtain a prompt initial reaction and uniform precipitation if the X in the $\gamma'$ phase is Al. The precipitation strengthening, however, becomes appreciable by substituting the Al in the $\gamma'$ phase by Ti or Nb and making the precipitates grow. The present inventors have made various experiments to determine the amount of Al necessary for the initial growth of the $\gamma'$ phase, as well as the optimum amounts of addition of Ti and Nb for the promotion of precipitation. As a result, it proved that at least a combination of more than 0.4% of Al and more than 0.7% of Ti is necessary for obtaining an appreciable aging hardenability. It proved also that an alloy having a high strength can be obtained by increasing the Al and Ti contents while adding Nb. It is remarkable that addition of more than 0.7% of Ti effectively prevents the cracking during forging. However, in the crevice corrosion test, a reduction in resistance to the stress corrosion cracking was observed when the Al and Ti contents were increased unlimitedly. For this reason, the Al and Ti contents should be selected to be smaller than 2% and 3%, respectively. An Nb content in excess of 5% permits the generation of coarse carbides and intermetallic compounds to undesirably degrade the mechanical properties and hot workability. The Nb content, therefore, should not exceed 4.5%. In a more strict sense, the Al, Ti and Nb contents should be selected to be, respectively, between 0.5 and 1.5%, 0.75 and 2%, and 1 and 4%.

It is preferred that the Al, Ti and Nb contents are determined to meet the following condition:

$$3.5\% \leqq (2Al + Ti + \tfrac{1}{2}Nb) \leqq 5.5\%.$$

Namely, in order to obtain a sufficient precipitation hardening, it is necessary that the amount (2 Al+Ti+½Nb) is greater than 3.5%. On the other hand, for obtaining a stable austenite matrix, this value should be selected to be less than 5.5%.

In view of the effect of each element or constituent stated above, the advantages of these elements or constituents will be most fully accomplished when the alloy is an austenite alloy consisting essentially of, by weight, 17 to 23% of Cr, 1.5 to 5% of Mo, 5 to 30% of Fe, 0.4 to 1.5% of Al, 0.7 to 2% of Ti, 1 to 4% of Nb and the balance Ni and unavoidable impurities.

It is not essential that the alloy contains C. In the case where the inclusion of C is unavoidable, it is advisable that the C content is limited to be less than 0.08%, in order to improve the corrosion resistance and to enhance the precipitation strengthening effect. More strictly, the C content should be selected to be between 0.02 and 0.06%.

The Si and Mn are added as deoxidizer and desulfurizer. In order to prevent the reduction in corrosion resistance, the Si and Mo contents should be selected to be less than 1%.

In order to prevent the segragation of P and S toward the grain boundaries and thus avoid the reduction in the corrosion resistance, the P and S contents should be selected to be less than 0.02%.

The addition of small amounts of B and Zr advantageously improve the strength at high temperature and the hot workability, respectively. In order to prevent the reduction in corrosion resistance at the grain boundaries, however, the B and Zr contents are preferably selected to be less than 0.02 and 0.2%, respectively. Incidentally, in the case where the parts are used in nuclear reactors, it is preferred to reduce the Co and Ta contents as low as possible, in order to reduce the radioactivity.

The addition of Cr, Mo, Ti and Nb to the alloy is preferably made by means of ferro-alloy, in order to achieve high yields of these elements. The content of Fe thus added in the form of ferro-alloy is preferably adjusted to be less than 40% and, more preferably, to be between 5 and 25%.

The Ni base alloy in accordance with the invention is characterized by having an aging hardenability which is an essential requisite for the high strength material for springs or the like parts, in addition to the superior resistance to the crevice corrosion cracking in hot water environment.

The alloy according to the invention is subjected to an aging hardening treatment subsequent to a solution heat treatment, so that the alloy has at least one of the $\gamma'$ phase and $\gamma''$ phase in the austenite matrix. The solution heat treatment following the melting and forging is conducted at a temperature which preferably ranges between 925° and 1150° C. More specifically, when the Nb content is less than 2%, the solution heat treatment is conducted at a temperature between 1,020° C. and 1,150° C., while, when the Nb content is greater than 2%, the solution heat treatment is conducted at a temperature between 925° C. and 1,100° C.

Generally speaking, the higher temperature of solution heat treatment provides a more uniform microstructure of the alloy. However, in the case where the alloy has a high Nb content, it is advisable to select a rather low temperature, in order to prevent any embrittlement at the grain boundaries and reduction in the corrosion resistance.

The aging treatment for attaining the precipitation strengthening may be preferably carried out in one time or in two or more times at different temperatures. In the case where the aging treatment is carried out in one time, the treatment is conducted preferably at a temperature between 620° C. and 750° C. If the aging treatment is carried out in two times, the first treatment is preferably carried out at a temperature between 720° C. and 870° C. and the second treatment is conducted at a temperature lower than the temperature of the first treatment, e.g. at a temperature between 620° C. and 750° C., in order to achieve a high mechanical strength and high resistance to the crevice corrosion cracking. However, in general, it is preferable to carry out the aging treatment in one time.

The material of the spring is required to have a high yield strength. In fact, in some cases, it is necessary that the material has a yield strength of about 100 $Kg/mm^2$ or higher at 0.2% proof stress. The material of the spring, therefore, is subjected to an aging treatment after the formation of the spring which is conducted directly after the solution heat treatment of the blank material or after a work hardening by a cold plastic work conducted following the solution heat treatment.

The material of the leaf spring is subjected, after a solution heat treatment, to a cold plastic work at a reduction in area of 10 to 70%. Then, the material is formed by a press or the like into the form of leaf spring and, thereafter, subjected to an aging hardening and then to a surface finishing treatment.

The material of the coiled spring is subjected, after a solution heat treatment, to a cold drawing at a reduction in area of less than 20%. The cold drawing, however, is not essential. The material is then worked into the form of a coiled spring and subjected to an aging treatment, before finally subjected to a surface finishing treatment.

The member in accordance with the invention can be used as various parts which are mounted in boiling water nuclear reactors. Examples of such parts are shown in Table 1.

DESCRIPTION OF THE PREFERRED EMBODIMENTS

Figure 1:
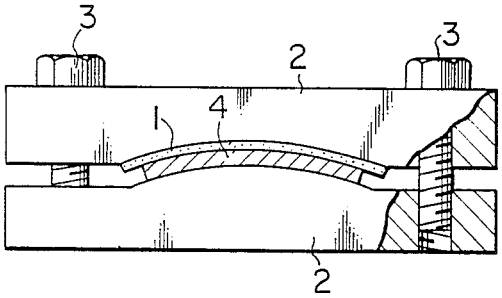
FIG. 1 is a sectional view of a jig used in a crevice stress corrosion cracking test conducted with a plate member.

As stated before, the member in accordance with the invention can be practically embodied in the form of various parts incorporated in boiling water reactors, as will be understood from the following Table 1 showing the examples of application.

TABLE 1

| Name of Equipments | Name of Parts |
|---|---|
| Jet pump | Retainer beam |
| | Spring |
| Internal structure of reactor | Anti-earthquake pin of shroud head |
| | Spring for shroud head bolt |
| Control rod driving mechanism (CRD) | Spud coupling |
| | Collet finger |
| | Collet spring |
| | Belleville spring |
| | Expansion spring for stop seal |
| | Expansion spring for outer seal |
| | Inner seal garter spring |
| | Clip |
| | Lower end spring |
| Fuel assembly | Spacer (spacer spring) |
| | Finger spring |
| | Expansion spring |
| | Channel fastener (spring) |

Typical examples of the application will be explained hereinunder with reference to the accompanying drawings.

EXAMPLE 1

Table 2 shows chemical compositions of typical examples of the alloy in accordance with the invention, together with the comparative materials.

TABLE 2

| Test materials | | Elements (wt %) | | | | | | | | |
|---|---|---|---|---|---|---|---|---|---|---|
| Class | Kind of alloy | Cr | Mo | Fe | C | Al | Ti | Nb | Ni | Remarks |
| Alloys of Invention | A | 19.1 | 2.2 | 12.5 | 0.06 | 0.6 | 1.4 | 3.5 | Bal. | — |
| | B | 17.8 | 4.0 | 22.1 | 0.02 | 0.5 | 2.0 | 2.1 | " | |
| | C | 22.2 | 3.2 | 16.4 | 0.05 | 1.0 | 1.5 | 2.8 | " | |
| | D | 24.6 | 1.9 | 6.5 | 0.02 | 0.5 | 0.8 | 4.2 | " | |

TABLE 2-continued

| Test materials | | | | | | | | | | |
|---|---|---|---|---|---|---|---|---|---|---|
| Class | Kind of alloy | Elements (wt %) | | | | | | | | Remarks |
| | | Cr | Mo | Fe | C | Al | Ti | Nb | Ni | |
| | E | 23.0 | 4.2 | 8.0 | 0.04 | 0.6 | 1.1 | 3.9 | " | |
| Reference | F | 16.1 | — | 7.2 | 0.05 | 0.7 | 2.7 | 1.1 | " | — |
| Alloys | G | 20.1 | — | 5.2 | 0.02 | 0.5 | 2.5 | 0.4 | " | |
| | H | 23.8 | — | 7.5 | 0.06 | 0.6 | 1.8 | 3.3 | " | |
| | I | 17.5 | 2.1 | 12.6 | 0.03 | 0.9 | 2.2 | 5.8 | " | |
| | J | 26.4 | 2.0 | 7.1 | 0.03 | 0.6 | 1.5 | 2.4 | " | Forging |
| | K | 23.3 | 8.8 | 4.9 | 0.04 | 0.5 | 1.2 | 2.4 | " | cracking |
| | L | 20.5 | 2.0 | 6.0 | 0.02 | 0.2 | 1.2 | 2.1 | " | — |
| | M | 20.4 | 2.0 | 5.8 | 0.02 | 0.5 | 0.4 | 2.2 | " | Serious forging cracking |

The alloys A to E of the invention and the comparative alloys F to M have been produced by a process having the steps of making an ingot through a couple of vacuum melting, forming the ingot into a desired form through repetitional hot forging and diffusion heat treatment (soaking) and subjecting the formed materials to a predetermined heat treatment. The ingots were formed into a bar-like form by the vacuum melting. A vacuum arc melting was effected using the thus formed ingots as electrodes. The aforementioned X750 alloy is shown as the comparative material F.

Table 3 shows the results of tests conducted with the alloys shown in Table 2, to examine the Vickers hardness (Hv) and the resistance to crevice constant-strain stress corrosion cracking in hot water. The test for examining the resistance to stress corrosion cracking mentioned above will be referred to as "crevice SCC test". The crevice SCC test was conducted in the following procedure.

Plate-like test pieces of 10 mm wide and 2 mm thick were obtained from each alloy. The test piece 1 was clamped by a holders 2 made of stainless steel (See FIG. 1) and bolts 3 were tightened to strongly press the test piece to impart thereto a uniform bending stress of 1%. A graphite wool 4 was placed on the cocave side of the test piece to form a crevice. The test piece 1 in the stressed condition was then immersed in water of a high temperature. The water was a re-generated circulated pure water of 288° C. containing 26 ppm of dissolved oxygen. After a continuous immersion for 500 hours, the cross-section of the test piece was observed by a microscope for a measurement of depths of cracks.

The alloys used in the test had microstructures consisting essentially of austenite phase matrix including one or both of the $\gamma'$ and $\gamma''$ phases.

The cooling after the heating in each of the solution heat treatment and the aging treatment was conducted by air cooling.

After the machining of each material into the form of test pieces, the test pieces were polished on their surfaces by #600 emery paper before subjected to the test.

TABLE 3

| Test material | | Hardness Hv (10 Kg) | Tests: Depth of cracks (◎: No cracking, ○ : ≦20 μm, ⦶: ≦100 μm, ⊗: >100 μm) — Heat treatment: 1060° C., 30 minutes + 720° C., 20 hours | | | 1060° C., 30 minutes + 840° C., 24 hours + 720° C., 20 hours | | | 980° C., 30 minutes + 720° C., 20 hours | | | 980° C., 30 minutes + 720° C., 8 hours + 620° C., 8 hours | | |
|---|---|---|---|---|---|---|---|---|---|---|---|---|---|---|
| Alloy of Invention | A | 382 | ◎ | ◎ | ◎ | ◎ | ◎ | ◎ | ◎ | ◎ | ◎ | ◎ | ◎ | ◎ |
| | B | 368 | ◎ | ◎ | ◎ | ◎ | ◎ | ◎ | ◎ | ◎ | ◎ | ◎ | ◎ | ◎ |
| | C | 355 | ◎ | ◎ | ◎ | ◎ | ◎ | ◎ | ◎ | ◎ | ◎ | — | | |
| | D | 413 | ◎ | ◎ | ○ | ◎ | ○ | ○ | ◎ | ◎ | ◎ | ◎ | ◎ | ◎ |
| | E | 373 | ◎ | ◎ | ◎ | ◎ | ◎ | ◎ | ◎ | ◎ | ◎ | — | | |
| Comparative Alloy | F | 352 | ⦶ | ⦶ | ⦶ | ⊗ | ⊗ | ⊗ | ⦶ | ⊗ | ⊗ | — | | |
| | G | 305 | ⦶ | ⦶ | ⊗ | ⦶ | ⊗ | ⊗ | ⦶ | ⦶ | ⊗ | — | | |
| | H | 370 | ⦶ | ⦶ | ⦶ | ⦶ | ⦶ | ⊗ | ⦶ | ⦶ | ⦶ | ⦶ | ⦶ | ⦶ |
| | I | 451 | ○ | ○ | ⊗ | ⦶ | ⦶ | ⊗ | ○ | ⦶ | ⊗ | ⦶ | ⦶ | ⦶ |
| | J | 344 | * | | | * | | | — | | | — | | |
| | K | 336 | * | | | * | | | — | | | — | | |
| | L | 288 | ◎ | ◎ | ◎ | × | ◎ | ◎ | ◎ | — | | — | | |
| | M | 310 | — | | | | — | | | — | | — | | |

* Embrittlement cracking

From Table 3, it will be seen that, while the alloys of the invention and the comparative alloys F, H, I exhibit sufficiently high hardnesses, the comparative alloy G having a small Nb content, comparative alloy L having a small Al content and the comparative alloy M having a small Ti content are not hardened sufficiently. Since the regulation requires that the spring materials used particularly in nuclear reactors have hardnesses greater than 300 Hv, the comparative alloy L apparently fails to meet this regulation.

As to the crevice SCC test, the comparative alloys F to I showed deep cracks irrespective of the various aging conditions. In contrast, all of the alloys A to E in accordance with the invention showed high resistance to the crevice stress corrosion cracking.

It is true that the resistance to crevice stress corrosion cracking is improved by increasing the Cr content also in the comparative alloys F to H. The effect of increase in Cr content, however, is small as compared with the alloys of the invention. This means that the increase in Cr content solely is insufficient and addition of Mo is essential for achieving a sufficiently high resistance to crevice stress corrosion cracking. On the other hand, it is also understood that, when the Nb content is increased beyond 5% as in the case of the comparative alloy I, cracks starting from coarse carbides or intermetallic compounds are easily formed. Further, the comparative alloy J having a Cr content in excess of 25% and the comparative alloy K having an Mo content exceeding 8% exhibit unacceptably low forgibility, and embrittlement cracking due to the presence of TCP phase was observed in the aged alloy. Incidentally, the comparative alloy M could not be used in the crevice SCC test because of a too heavy cracking during being forged.

EXAMPLE 2

Table 4 shows, in weight percent, the chemical compositions of alloy materials of a leaf spring in accordance with the invention, in comparison with those of reference alloy materials.

TABLE 4

| Test materials | | Elements (wt %) | | | | | | | |
|---|---|---|---|---|---|---|---|---|---|
| Class | No. | Cr | Mo | Fe | Al | Ti | Nb | C | Ni |
| Alloys of Invention | B | 17.8 | 4.0 | 22.1 | 0.50 | 2.0 | 2.1 | 0.02 | Balance |
| | N | 20.0 | 3.1 | 14.7 | 0.45 | 1.5 | 3.7 | 0.03 | Balance |
| | O | 22.9 | 2.1 | 6.8 | 0.60 | 0.9 | 4.0 | 0.04 | Balance |
| Comparative Alloys | P | 15.7 | — | 7.3 | 0.56 | 2.5 | 1.0 | 0.04 | Balance |
| | Q | 18.5 | 3.1 | 18.6 | 0.45 | 0.9 | 5.1 | 0.03 | Balance |

The alloy materials were molten in the same manner as Example 1 and then shaped into the form of leaf springs by hot forging. The comparative alloy P and the comparative alloy Q correspond to the X750 alloy mentioned before and inconel 718 alloy, respectively. Test pieces obtained from these alloys were subjected to a crevice SCC test in hot water, in the same manner as Example 1. The sample alloys B, N, O and P were subjected to a solution heat treatment conducted at 1,060° C., while the sample alloy Q was subjected to a solution heat treatment conducted at 950° C. Subsequently, all sample alloys were subjected to a cold plastic work and then to an aging treatment. The surfaces of the aged materials were polished by #600 emery paper.

TABLE 5

| Class | Kinds of Alloys | Reduction in Area by Cold Rolling (%) | Aging Condition | 0.2% Proof stress at Room Temp. (kg/mm$^2$) | Crevice SCC Test Max. Crack Depth ≧30 μm | Max. Crack Depth ≧100 μm |
|---|---|---|---|---|---|---|
| Alloys of Invention | B | 0 | 700° C., 20 h | 75.5 | 0 | 0 |
| | | 8 | " | 87.1 | 0 | 0 |
| | | 20 | " | 101.2 | 0 | 0 |
| | | 60 | " | 114.7 | 0 | 0 |
| | N | 20 | " | 113.9 | 0 | 0 |
| | | 60 | " | 133.2 | 0 | 0 |
| | O | 20 | " | 122.5 | 0 | 0 |
| | | 60 | " | 140.2 | 0 | 0 |
| Comparative Alloys | P | 0 | " | 79.6 | 6 | 4 |
| | | 30 | " | 104.8 | 1 | 9 |
| | Q | 0 | 720° C., 8 h + 620° C., 8 h | 121.0 | 3 | 0 |
| | | 30 | " | 142.5 | 5 | 1 |

Table 5 shows the results of tests conducted for examining the 0.2% proof stress at room temperature of a plurality of kinds of leaf springs produced from the alloy materials shown in Table 4 under different conditions of production, as well as the resistance to the crevice stress corrosion cracking of these leaf springs. The crevice SCC test was conducted with 10 (ten) test pieces for each kind of leaf spring, and the number of the test pieces exhibiting any crack out of 10 is shown in Table 5.

From Table 5, it will be seen that the leaf springs in accordance with the invention showed high resistances to the crevice stress corrosion cracking. In fact, none of the test pieces of the leaf springs in accordance with the invention showed cracking. All of the test pieces which had been subjected to the cold plastic works of reduction in area greater than 20% showed 0.2% proof stress exceeding 100 Kg/cm$^2$. Cracks were observed, however, in all of the test pieces of the comparative alloys.

EXAMPLE 3

Figure 4:
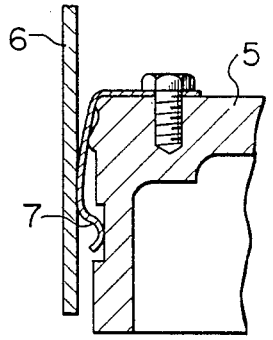
FIG. 4 is a sectional view of a finger spring disposed between a channel box and a tie plate of a nuclear fuel assembly in a portion IV of the nuclear reactor shown in FIG. 3.
Figure 5:
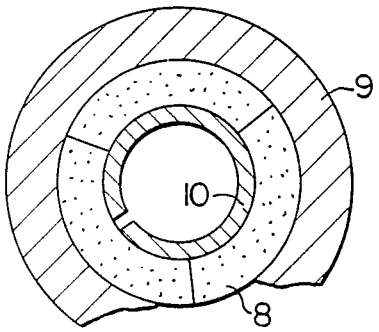
FIG. 5 is a sectional view of an expansion spring adapted for fixing a graphite seal of a control rod driving mechanism provided at a portion V in the nuclear reactor shown in FIG. 3 to an index tube.

In accordance with the test result explained in connection with Example 2, a finger spring 7 as shown in FIG. 4 and an expansion spring 10 as shown in FIG. 5 were produced from the alloy N shown in Table 4. Incidentally, in these Figures, 5 represents a tie plate, 6 a channel box, 8 a graphite seal, and 9 an index tube. Each of the spring material was subjected, as in the case of Example 1, to a solution heat treatment following a melting and hot forging, and then to a cold plastic work of a reduction in area of 30%. Then, after a smoothing of the surfaces by finishing rolls, the material was shaped by a cold press into the form of spring, and was subjected to an aging which was conducted at 700° C. for 20 hours, followed by a final surface finishing treatment.

EXAMPLE 4

Coiled springs were produced from the alloys shown in Table 4 and were subjected to a crevice SCC test in hot water. The springs were formed by subjecting the material alloys to a solution heat treatment conducted at same temperatures as in Example 2 and, with or without a cold drawing of a reduction in area of 10%, to a coiling followed by an aging treatment.

Figure 2:
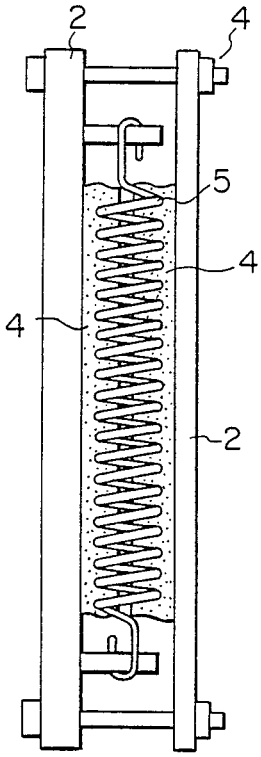
FIG. 2 is a sectional view of a jig used in a crevice stress corrosion cracking test conducted with a coiled spring.
Figure 3:
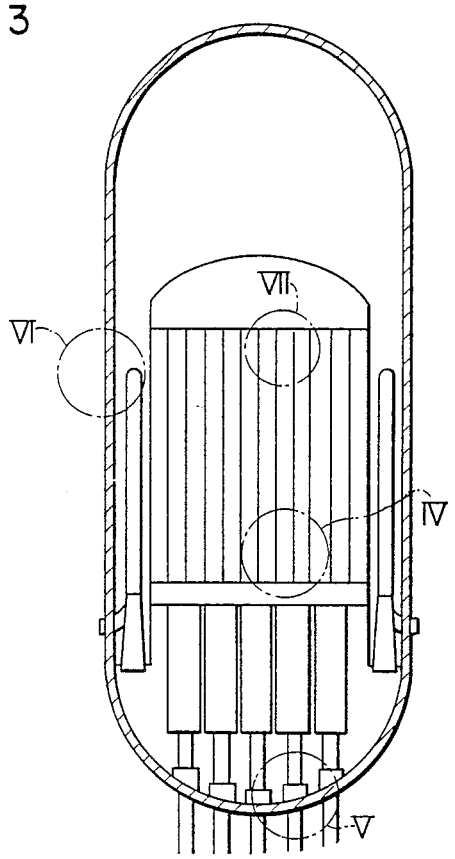
FIG. 3 is a sectional view of a boiling water nuclear reactor.

The crevice SCC test was conducted in a manner shown in FIG. 2. Namely, the test piece was stretched to a length 25% greater than the length in the free state, and was clamped at its both sides by holders 2 made of a stainless steel, with layers of graphite wool 4 therebetween. The test piece was then immersed in a hot water for 1,000 hours as in the case of Example 1. The test piece, i.e. the coiled spring, is designated by a reference numeral 5 in FIG. 2.

Table 6 shows the result of the crevice SCC test in relation to the conditions of the cold work and aging treatment. It will be seen from Table 6 that the test pieces of coiled spring in accordance with the invention showed no crevice corrosion cracking, while all of the comparative test pieces of coiled spring showed rupture or cracking.

ing and hot forging. Then, the material was subjected to a cold drawing of reduction in area of 10% to form a wire of about 0.4 mm dia. which was then formed into a coil of an outside diameter of about 1.2 mm. The coil was then subjected to an aging treatment conducted for 20 hours at 700° C.

As has been described, according to the invention, it is possible to obtain members or parts to be mounted in nuclear reactors, the members or parts being made of Ni base alloys which exhibit a high resistance to stress corrosion cracking in water of a high temperature and pressure in the presence of crevice. The members in accordance with the invention, therefore, can be used safely for a longer period of time than the conventional

TABLE 6

| | | | Condition of Production | | | |
|---|---|---|---|---|---|---|
| Class | Kind of Alloys | Wire Dia. (mm) | Kind of Work | Coil Outside Dia. (mm) | Aging Treatment | State after Crevice SCC Test |
| Alloys of Invention | B | 0.35 | Coiling | 1.5 | 650° C., 4 h | No Cracking |
| | | 0.35 | Coiling | 1.5 | 700° C., 20 h | No Cracking |
| | | 2.0 | 10% Cold Drawing and Coiling | 20 | 700° C., 20 h | No Cracking |
| | N | 0.35 | Coiling | 1.5 | 650° C., 4 h | No Cracking |
| | | 0.35 | Coiling | 1.5 | 700° C., 20 h | No Cracking |
| | | 2.0 | 10% Cold Drawing and Coiling | 20 | 700° C., 20 h | No Cracking |
| | O | 0.35 | Coiling | 1.5 | 650° C., 4 h | No Cracking |
| | | 0.35 | Coiling | 1.5 | 700° C., 20 h | No Cracking |
| | | 2.0 | Coiling | 20 | 700° C., 20 h | No Cracking |
| Comparative Alloys | P | 0.35 | Coiling | 1.5 | 650° C., 4 h | Rupture |
| | | 0.35 | Coiling | 1.5 | 700° C., 20 h | Rupture |
| | | 2.0 | 10% Cold Drawing and Coiling | 20 | 700° C., 20 h | Cracked |
| | Q | 0.35 | Coiling | 1.5 | 720° C., 8 h + 620° C., 8 h | Cracked |
| | | 2.0 | Coiling | 20 | 720° C., 8 h + 620° C., 8 h | Cracked |

EXAMPLE 5

Figure 6:
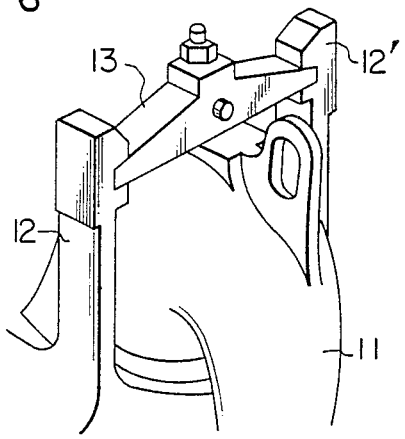
FIG. 6 is a perspective view of a retainer beam extended between arms so as to press downwardly an elbow pipe of a jet pump disposed at a portion VI of the nuclear reactor shown in FIG. 3.

The alloy N shown in Table 4 was produced by melting and subjected to a subsequent hot forging in the same manner as Example 1. The alloy material was then formed by a die forging into a retainer beam 13 of jet pump as shown in FIG. 6. Incidentally in this Figure, 11 represents an elbow pipe, and 12, 12' an arm. After the die forging, a solution heat treatment was conducted in the same manner as Example 2. Then, after a mechanical processing into the desired shape, an aging was conducted for 20 hours at 700° C., followed by a surface finishing treatment.

EXAMPLE 6

Figure 7:
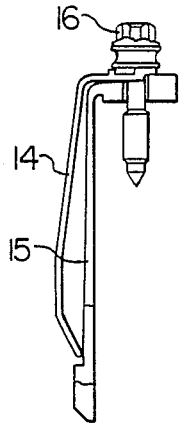
FIG. 7 is a sectional view of a cap screw for fixing a spring to a guard of the fuel assembly at a portion VII of the nuclear reactor shown in FIG. 3.

A cap screw 16 as shown in FIG. 7, for fixing a spring 14 to a guard 15 of a nuclear fuel assembly, was produced from the alloy N shown in Table 4 by a thread rolling following a melting and a hot forging which are conducted in the same way as Example 1. After the thread rolling, a solution heat treatment, aging treatment and a surface finish treatment were conducted as in the case of Example 5.

EXAMPLE 7

Figure 8A:
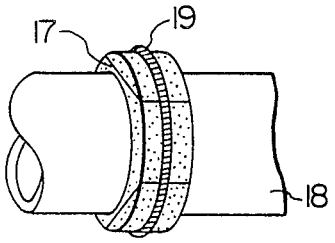
FIG. 8*a* is a perspective view of a garter spring for fixing a graphite seal to a piston tube.
Figure 8B:
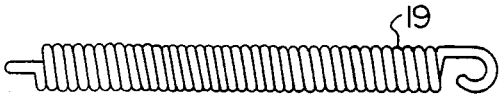
FIG. 8*b* is a side elevational view of the garter spring in the state out of use.

With the knowledge of the test result of Example 4, a garter spring 19 as shown in FIGS. 8*a* and 8*b* was produced from the alloy N shown in Table 4. Incidentally, in FIG. 8*a*, 17 represents a graphite seal, and 18 a piston tube. As in the case of Example 1, the alloy was subjected to a solution heat treatment following the meltones in nuclear reactors.

What is claimed is:

1. A method of relieving stress corrosion of a high strength member in contact with water of at least 288° C. of a nuclear reactor, which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, and the balance more than 40% of Ni; forming said high strength member from said alloy, and placing said high strength member in such a position that the member is in contact with water of at least 288° C. of a nuclear reactor and a stress is applied to said high strength member; said alloy having an austenite matrix containing at least one of $\gamma'$ phase and $\gamma''$ phase.

2. A method as claimed in claim 1, wherein the Al content, Ti content and the Nb content are selected to meet the following condition:

$$3.5 \text{ wt } \% \leqq (2Al + Ti + \tfrac{1}{2}nb) \leqq 5.5 \text{ wt } \%.$$

3. A method as claimed in claim 1, wherein said Ni base alloy consists essentially of, by weight, 17 to 23% of Cr, 1.5 to 5% of Mo, 5 to 25% of Fe, 0.4 to 1.5% of Al, 0.7 to 2% of Ti to 4% of Nb and more than 50% of Ni.

4. A method of relieving stress corrosion of a finger spring disposed between a tie plate of a nuclear fuel assembly and a fuel channel in a nuclear reactor in contact with water of at least 288° C., which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% Fe, and the balance more than 40% of Ni; forming said finger spring from said alloy, and placing said finger spring in such a position that the finger spring is in contact with water of at least 288° C. of a nuclear reactor and a stress is applied to said finger spring; said alloy having an austenite matrix containing at least one of $\gamma'$ phase and $\gamma''$ phase.

5. A method of relieving stress corrosion of an expansion spring consisting of a leaf spring and adapted for fixing a graphite seal of a fuel rod driving mechanism in a nuclear reactor in contact with water of at least 288° C., which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, and the balance more than 40% of Ni; forming said expansion spring from said alloy, and placing said expansion spring in such a position that said expansion spring is in contact with water of at least 288° C. of a nuclear reactor and a stress is applied to said expansion spring; said alloy having an austenite matrix containing at least one of $\gamma'$ phase and $\gamma''$ phase.

6. A method of relieving stress corrosion of a retainer beam for pressing and retaining an elbow pipe of a jet pump in a nuclear reactor in contact with water of at least 288° C., which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, and the balance more than 40% of Ni; forming said retainer beam from said alloy, and placing said retainer beam in such a position that said retainer beam is in contact with water of at least 288° C. of a nuclear reactor and a stress is applied to said retainer beam; said alloy having an austenite matrix containing at least one of $\gamma'$ phase and $\gamma''$ phase.

7. A method of relieving stress corrosion of a garter spring consisting of a coiled spring and adapted for fixing a graphite seal of a fuel rod driving mechanism to a piston tube in a nuclear reactor in contact with water of at least 288° C., which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, and the balance more than 40% of Ni; forming said garter spring from said alloy, and placing said garter spring in such a position that said garter spring is in contact with water of at least 288° C. of a nuclear reactor and a stress is applied to said garter spring; said alloy having an austenite matrix containing at least one of $\gamma'$ phase and $\gamma''$ phase.

8. A method of relieving stress corrosion of a cap screw consisting of a bolt for fixing a spring to a guard of a nuclear fuel assembly in a nuclear reactor in contact with water of at least 288° C., which comprises providing an alloy consisting essentially of, by weight, less than 0.08% of C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, and the balance more than 40% of Ni; forming said cap screw from said alloy, and placing said cap screw in such a position that said cap screw is in contact with water of at least 288° C. of a nuclear reactor and a stress is applied to said cap screw; said alloy having an austenite matrix containing at least one of $\gamma'$ phase and $\gamma''$ phase.

9. A method of producing a member which is part of a nuclear reactor and which is made from a Ni base alloy having a high resistance to stress corrosion cracking and adapted for use under a stress in an atmosphere of a temperature below the creep temperature, said method comprising the steps of: making by vacuum melting an ingot of an alloy consisting essentially of, by weight, less than 0.08% C, less than 1% Si, less than 1% Mn, 15 to 25% Cr, 1 to 8% of Mo, 0.4 to 2% of Al, 0.75 to 2% of Ti, 1 to 4% of Nb, 5 to 25% of Fe, the balance being more than 40% of Ni, with the ratio of Nb/Ti varying from 1.0 to 3.5; effecting plastic work on said ingot by repeatedly subjecting said ingot to a hot forging and diffusion treatment (soaking); forming said ingot into a member of desired form; and subjecting the formed member to a solution heat treatment and then to an aging treatment to cause a precipitation of at least one of $\gamma'$ phase and $\gamma''$ phase in an austenite matrix; said member being subjected to the hot, pure water in a nuclear reactor at a temperature of at least 288° C. and forming a crevice between itself and another member, the alloy composition and the hardness of the alloy being so adjusted as to exhibit a Vickers hardness of not smaller than 300 at room temperature and to show no cracking when immersed in the pure water at 288° C. containing 26 ppm dissolved oxygen for 500 hours under a bending strain of 1%.

10. A method as claimed in claim 9, wherein said vacuum melting is effected two times.

11. A method of producing a member which is part of a nuclear reactor wand which is made from a Ni base alloy having a high resistance to stress corrosion cracking and adapted for use under a stress in an atmosphere of a temperature below the creep temperature, said method comprising the steps of: producing a blank material of an alloy consisting essentially of, by weight, less than 0.08% C, less than of 1% Si, less than 1% of Mn, 15 to 25% of Cr, 1 to 8% of Mo, 0.4 to 2% of Al, 0.75 to 2% of Ti, 1 to 4% of Nb, 5 to 25% of Fe, the balance being more than 40% of Ni, with the ratio of Nb/Ti varying from 1.0 to 3.5; subjecting said blank material to a cold plastic work after subjecting it to a solution heat treatment; forming said blank material into a member of desired form; and subjecting the formed member to an aging treatment to cause a precipitation of at least one of $\gamma'$ phase and $\gamma''$ phase in an austenite matrix; said member being subjected to the hot, pure water in a nuclear reactor at a temperature of at least 288° C. and forming a crevice between itself and another member, the alloy composition and the hardness of the alloy being so adjusted as to exhibit a Vickers hardness of not smaller than 300 at room temperature to show no cracking when immersed in the pure water at 288° C. containing 26 ppm dissolved oxygen for 500 hours under a bending strain of 1%.

12. A method of producing a member which is part of a nuclear reactor and which is made from a Ni base alloy having a high resistance to stress corrosion cracking and adapted for use under a stress in an atmosphere of a temperature below the creep temperature, said method comprising the steps of: producing a blank material of an alloy consisting essentially of, by weight, less than 0.08% C, less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, the balance being more than 40% of Ni, with the ratio of Nb/Ti varying from 1.0 to 3.5; die-forming said blank material into a member of desired shape after subjecting it to a solution heat treatment; and subjecting said member to an aging treatment to cause a precipitation of at least one of $\gamma'$ phase and $\gamma''$ phase in an austenite matrix; said member being subjected to the hot, pure water in a nuclear reactor at a temperature of at least 288° C. and forming a crevice between itself and another member, the alloy composition and the hardness of the alloy being so adjusted as to exhibit a Vickers hardness of not smaller than 300 at room temperature and to show no cracking when immersed in the pure water at 288° C. containing 26 ppm dissolved oxygen for 500 hours under a bending strain of 1%.

13. A method as claimed in claim 12, wherein said member is a finger plate disposed between a tie place of a nuclear fuel assembly and a fuel channel in a nuclear reactor.

14. A method as claimed in claim 12, wherein said member is an expansion spring consisting of a leaf spring and adapted for fixing a graphite seal of a fuel rod driving mechanism to an index tube in a nuclear reactor.

15. A method of relieving stress corrosion of a high strength member in contact with water of at least 288° C. of a nuclear reactor, which comprises providing an alloy consisting essentially of, by weight, less than 0.08% C., less than 1% of Si, less than 1% of Mn, 15 to 25% of Cr, 1 to 8% of Mo, 0.4 to 2% of Al, 0.75 to 2% of Ti, 1 to 4% of Nb, 5 to 25% of Fe, the balance being more than 40% of Ni, the Al content, the Ti content and the Nb content being selected to meet the following condition:

$$3.5 \text{ wt } \% \leqq (2Al + Ti + \tfrac{1}{2}Nb) \leqq 5.5 \text{ wt } \%;$$

said alloy having an austenite matrix containing at least one of $\gamma'$ and $\gamma''$ phase, forming said high strength member from said alloy and placing the high strength member in contact with water of at least 288° C. of a nuclear reactor.

16. A method of relieving stress corrosion of a high strength member in contact with water of at least 288° C. of a nuclear reactor, which comprises providing an alloy consisting essentially of, by weight, about 0.06% of C, less than 1% of Si, less than 1% of Mn, about 19.1% of Cr, about 2.2% of Mo, about 0.6% of Al, about 1.4% of Ti, about 3.5% of Nb, about 12.5% of Fe, and the balance of Ni; forming said high strength member from said alloy, and placing said high strength member in such a position that said high strength member is in contact with water of at least 288° C. of a nuclear reactor and a stress is applied to said high strength member; said alloy having an austenite matrix containing at least one of $\gamma'$ phase and $\gamma''$ phase.

17. A method of relieving stress corrosion of a high strength member in contact with water of at least 288° C. of a nuclear reactor, which comprises providing an alloy consisting essentially of, by weight, less than 0.02–0.06% of C, less than 1% of Si, less than 1% of Mn, 17.8–24.6% of Cr, 1.9 to 4.2% of Mo, 0.45–1.0% of Al, about 0.6% of Ti, 21 to 4.2% of Nb, 6.5 to 22.1% of Fe, and the balance of Ni; forming said high strength member from said alloy, and placing said high strength member in such a position that said high strength member is in contact with water of at least 288° C. of a nuclear reactor and a stress is applied to said high strength member; said alloy having an austenite matrix containing at least one of $\gamma'$ phase and $\gamma''$ phase.

18. A member which is a part of a nuclear reactor and which is made from a Ni base alloy having a high resistance to stress corrosion cracking and used under a stress in an atmosphere of a temperature below the creep temperature, characterized in that said Ni base alloy consists essentially of, by weight, less than 0.08% C, less than 1% Si, less than 1% Mn, 15 to 25% Cr, 1 to 8% of Mo, 0.4 to 2% of Al, 0.75 to 2% of Ti, 1 to 4% of Nb, 5 to 25% of Fe, the balance being more than 40% of Ni, with the ratio of Nb/Ti varying from 1.0 to 3.5, and has an austenite matrix containing at least one of $\gamma'$ phase and $\gamma''$ phase; said member being subjected to the hot, pure water in a nuclear reactor at a temperature of at least 288° C. and forming a crevice between itself and another member, the alloy composition and the hardness of the alloy being so adjusted as to exhibit a Vickers hardness of not smaller than 300 at room temperature and to show no cracking when immersed in the pure water at 288° C. containing 26 ppm dissolved oxygen for 500 hours under a bending strain of 1%.

19. A member as claimed in claim 18, wherein the Al content, Ti content and the Nb content are selected to meet the following condition:

$$3.5 \text{ wt } \% \leqq (2Al + Ti + \tfrac{1}{2}nb) \leqq 5.5 \text{ wt } \%.$$

20. A member as claimed in claim 18, wherein said Ni base alloy consists essentially of, by weight, 17 to 23% of Cr, 1.5 to 5% of Mo, 5 to 25% of Fe, 0.4 to 1.5% of Al, 0.7 to 2% of Ti to 4% of Nb and more than 50% of Ni.

* * * * *